US006701897B2

(12) United States Patent
Chatfield

(10) Patent No.: US 6,701,897 B2
(45) Date of Patent: Mar. 9, 2004

(54) ENGINE FUEL DELIVERY MANAGEMENT SYSTEM

(75) Inventor: Glen F. Chatfield, Bradfordwoods, PA (US)

(73) Assignee: Optimum Power Technology, Bridgeville, PA (US)

( * ) Notice: Subject to any disclaimer, the term of this patent is extended or adjusted under 35 U.S.C. 154(b) by 293 days.

(21) Appl. No.: 09/909,679

(22) Filed: Jul. 20, 2001

(65) Prior Publication Data

US 2003/0000500 A1 Jan. 2, 2003

Related U.S. Application Data

(63) Continuation-in-part of application No. 09/784,336, filed on Feb. 16, 2001, now Pat. No. 6,539,299.

(51) Int. Cl.[7] ..... F02M 1/00
(52) U.S. Cl. ..... 123/438; 123/492; 123/493
(58) Field of Search ..... 123/492, 493, 123/438

(56) References Cited

U.S. PATENT DOCUMENTS 4,562,814 A * 1/1986 Abo et al. ..... 123/488
4,596,221 A 6/1986 Ament et al.
4,655,186 A * 4/1987 Takeda et al. ..... 123/480
4,843,556 A * 6/1989 Wakeman et al. ..... 701/111
4,852,538 A 8/1989 Nagaishi
4,987,890 A 1/1991 Nagaishi
5,031,597 A 7/1991 Monden
5,375,583 A * 12/1994 Meyer et al. ..... 123/681
5,560,339 A 10/1996 Yoshioka et al.
5,611,314 A * 3/1997 Fuwa et al. ..... 123/491
5,762,046 A * 6/1998 Holmes et al. ..... 123/497
5,881,688 A * 3/1999 Graham et al. ..... 123/73 AD
5,929,609 A * 7/1999 Joy et al. ..... 322/25
6,343,596 B1 * 2/2002 Hajji et al. ..... 123/676

FOREIGN PATENT DOCUMENTS

DE 40 40 637 6/1992

* cited by examiner

*Primary Examiner*—John Kwon
(74) *Attorney, Agent, or Firm*—Richard W. James

(57) ABSTRACT

An apparatus and method for adjusting a quantity of fuel delivered to an engine when an engine operating state transitions is provided. The apparatus and method includes determining a current steady-state quantity of fuel to be delivered to the engine and add a transitory quantity of fuel, based on a difference between a previous steady-state quantity of fuel delivered and the current steady-state quantity of fuel to be delivered, to the current steady-state quantity of fuel for a period of time following initiation of the transition. The invention also provides an apparatus and method by which an operator may adjust the amount of fuel delivered during an engine operating state transition.

55 Claims, 4 Drawing Sheets

ENGINE FUEL DELIVERY MANAGEMENT SYSTEM

CROSS-REFERENCE TO RELATED APPLICATIONS

The present application is a continuation-in-part of U.S. patent application Ser. No. 09/784,336, filed Feb. 16, 2001, now U.S. Pat. No. 6,539,299 which is currently and assigned to the assignee of the present invention. The entirety of this earlier filed patent application is hereby expressly incorporated herein by reference.

FIELD OF THE INVENTION

The present invention is directed to an engine fuel delivery management system for an internal combustion engine. In particular, this invention is directed to a system and method that compensates for a change in engine operating state by altering an amount of an operating parameter, such as quantity of fuel to be delivered.

BACKGROUND OF THE INVENTION

It is believed that the performance of an internal combustion engine is dependent on a number of factors including the operating cycle (e.g., two-stroke having 360 degrees of crankshaft rotation per cycle, four-stroke having 720 degrees of crankshaft rotation per cycle, or Wankel), the fuel type (e.g., gasoline or diesel) the number and design of combustion chambers, the selection and control of ignition and fuel delivery systems, and the ambient conditions in which the engine operates.

Examples of design choices for a combustion chamber are believed to include choosing a compression ratio and choosing the numbers of intake and exhaust valves associated with each chamber. In general, it is believed that these choices cannot be changed so as to calibrate engine operation after the engine has been built.

With regard to ignition systems, breaker point systems and electronic ignition systems are known. It is believed that these known systems provide spark timing based on an operating characteristic of the engine, e.g., speed of rotation and load. In the case of breaker point systems, it is believed that engine speed is frequently detected mechanically using centrifugally displaced weights, and that intake manifold pressure or exhaust manifold pressure is commonly used to detect engine load. In the case of electronic ignition systems, it is believed that engine speed is generally detected with an angular motion sensor associated with rotation of the crankshaft, and that engine load is frequently detected, for example, by the output of a throttle position sensor, intake manifold pressure or mass airflow sensor. In each case, spark timing is typically fixed for a given steady operating state of the engine.

With regard to fuel delivery systems, carburetors and fuel injection systems are known. It is believed that those known systems supply a quantity of fuel, e.g., gasoline and air, in accordance with the position of the throttle as set by the operator. In the case of carburetors, it is believed that fuel is delivered by a system of orifices, known as "jets." As examples of carburetor operation, it is believed that an idle jet may supply fuel downstream of a throttle valve at engine idling speeds, and that fuel delivery may be boosted by an accelerator pump to facilitate rapid increases in engine load. It is believed that most carburetors must be disassembled and different size jets or pumps installed to modify the amount of fuel delivery at a particular engine load. However, that is a laborious process that, it is believed, most often, can only be done while the engine is not running.

It is believed that known fuel injection systems, which can be operated electronically, spray a precisely metered amount of fuel into the intake system or directly into the combustion cylinder. The fuel quantity is believed to be determined by a controller based on the state of the engine and a data table known as a "map" or "look-up table." It is believed that the map includes a collection of possible values or "setpoints" for each of at least one independent variable (i.e., a characteristic of the state of the engine), which can be measured by a sensor connected to the controller, and a collection of corresponding control values, for a dependent variable control function, e.g., fuel quantity.

Conventionally, it is believed that maps are developed by the engine manufacturer and permanently set in an engine control unit at the factory. Currently, for on-road vehicles, this is believed to be legally required in order to meet emissions regulations. However, it is believed that even when it is not legally required, the manufacturers prevent engine operators from modifying the maps for a variety of reasons, such as the manufacturers believe that their maps provide the best engine performance, the manufacturers are concerned that an engine operator might damage the engine by specifying inappropriate control values, or the manufacturers assume that an engine operator might not have sufficient skill to properly modify a map. However, it is believed that the manufacturers have "optimized" their maps to perform best under a set of conditions that they specify. In certain cases, however, it is believed that those conditions do not match the conditions in which the engine is operated. Consequently, stock maps sometimes limit, rather than optimize, an engine's performance.

Conventional maps, furthermore, are typically created to provide fuel delivery and ignition timing suitable for the engine when operating at a steady-state. Thus, map values may not be appropriate for an engine operating in transition such as, for example, an accelerating or decelerating engine.

Further, engine performance is believed to be substantially dependent on how combustion is accomplished in the ambient conditions. The stoichiometric mass fraction ratio of air to gasoline is approximately 14.7:1. However, it is believed that ratios from about 10:1 to about 20:1 will combust, and that it is often desirable to adjust the air-fuel ratio ("AFR") to achieve specific engine performance (e.g., a certain level of power output, better fuel economy, or reduced emissions). Properly calibrating the fuel delivery system of an engine to deliver the optimum AFR under all operating conditions is one of the most important goals of a calibration effort. It is also frequently the most time consuming, difficult, and costly part of the calibration effort. Similarly, it is also believed to be desirable to adjust ignition timing, commonly measured in degrees of crank rotation before a piston reaches top-dead-center of the compression stroke, to achieve specific engine performance (e.g., lowest fuel consumption or reduced emissions).

It is believed to be a disadvantage of known ignition timing systems and fuel delivery systems that engine operation is constrained by the fixed controls established by the suppliers of these systems. It is also believed that a simple, effective system and method for varying fuel delivery during engine operating state transitions is needed. Thus, there is believed to be a need to overcome the disadvantages of known fuel delivery systems.

SUMMARY OF THE INVENTION

The present invention is directed to a system, method and apparatus for adjusting a quantity of fuel delivered to an engine when an engine operating state transitions. In accordance with one form of the present invention, there is provided such a method that includes determining from a data table a current steady-state quantity of fuel to be delivered to the engine under a steady-state condition and adding a transitory quantity of fuel to the current steady-state quantity of fuel. The transitory quantity of fuel is based on a difference between a previous steady-state quantity of fuel delivered and the current steady-state quantity of fuel to be delivered. The steady-state quantity of fuel is a quantity of fuel delivered or to be delivered to an engine when the engine is operating at any steady-state. The data table from which the steady-state quantity of fuel is determined may be a two-dimensional map utilizing engine load and engine speed to determine steady-state fuel quantity. The steady-state quantity determined may be the closest value on the map corresponding to an engine operating state that is retrieved and used as the required steady-state fuel mass required. Alternately, the steady-state value may be interpolated from multiple values on the map. For example, when interpolation is used the steady-state value may be interpolated from the two speed values closest to the current engine operating state and the two load values closest to the current engine operating state. A transition occurs when an engine shifts from one operating state to another. A transition may, therefore, correspond to any movement from any one position to any other position on a map. Compensation for transitions resulting in both positive and negative transitory fuel quantities may be implemented and different weights may be placed on positive and negative transitory fuel quantities.

The present invention is also directed to an engine transitional fuel control apparatus and method of operating that apparatus. The engine transitional fuel control apparatus includes a processor, a fuel supply device; and a fuel supply actuator. The processor has an output and a memory, whereby the memory contains a fuel delivery table and instructions. When executed by the processor, the instructions cause the processor to determine a steady-state amount of fuel to be delivered, add a transitory quantity of fuel to the steady-state amount of fuel to be delivered for a period of time following initiation of the transition, and apply a signal corresponding to that total amount of fuel to the output. The steady-state amount of fuel to be delivered is determined by reference to the fuel delivery table and the transitory quantity of fuel is based on a difference between a previously determined steady-state quantity of fuel and the current steady-state amount of fuel to be delivered. The fuel supply actuator is coupled to the output of the processor and operably coupled to the fuel supply device to control fuel flow therethrough.

The present invention provides a number of advantages including the ability for fuel delivery to be adjusted electronically without need for component removal or system disassembly. Another advantage is the ability of the present invention to electronically adjust fuel delivery, including specifically transitory fuel quantity, while the engine is running. Yet another advantage is that fuel supply to an engine can be controlled by way of a program that compensates for changes in engine operating state. Another advantage is that fuel supply to an engine can be controlled by way of a program that compensates for desired changes in engine operation.

Accordingly, the present invention provides solutions to the shortcomings of prior engine control systems and methods. Those of ordinary skill in the art will readily appreciate, therefore, that those and other details, features, and advantages of the present invention will become further apparent in the following detailed description of the preferred embodiments of the invention.

BRIEF DESCRIPTION OF THE DRAWINGS

The accompanying drawings, which are incorporated herein and constitute part of this specification, include one or more embodiments of the invention, and together with a general description given above and a detailed description given below, serve to disclose principles of the invention in accordance with a best mode contemplated for carrying out the invention.

DETAILED DESCRIPTION OF THE INVENTION

Reference will now be made in detail to the preferred embodiments of the present invention, examples of which are illustrated in the accompanying drawings. It is to be understood that the Figures and descriptions of the present invention included herein illustrate and describe elements that are of particular relevance to the present invention, while eliminating, for purposes of clarity, other elements found in typical engines and engine control systems.

As they are used in connection with the present invention, the expressions "trim" or "trimming," "group," "trim definition," and "map set" have specific meanings. The expressions "trim" and "trimming" refer to changing the value of one or more map setpoints or transient operating parameters. The value of this change, which can be positive or negative, can be a function of the original value or a selected increment. The expression "group" refers to an aggregation or parcel of setpoints or transient operating parameters that are acted upon in unison by a trimming action. A group can be defined by a "trim definition." For example, a trim definition can parcel out an engine control map so as to create a group of setpoints that lie within one or more selected ranges of one or more independent variables, e.g., sensed engine operating characteristics. The expression "map set" refers to a single engine control map and/or transient operating parameter or to an association of more than one related engine control map or transient operating parameter. For example, a map set can consist solely of a fuel delivery map. Alternatively, a map set might comprise an ignition timing map, a fuel delivery map, and increasing and decreasing fuel transient operating parameters.

It is also noted that any reference in the specification to "one embodiment" or "an embodiment" means that a particular feature, structure or characteristic described in connection with the embodiment is included in at least one embodiment of the invention. The appearances of phrases such as "in one embodiment" in various places in the specification are not necessarily all referring to the same embodiment.

Figure 1:
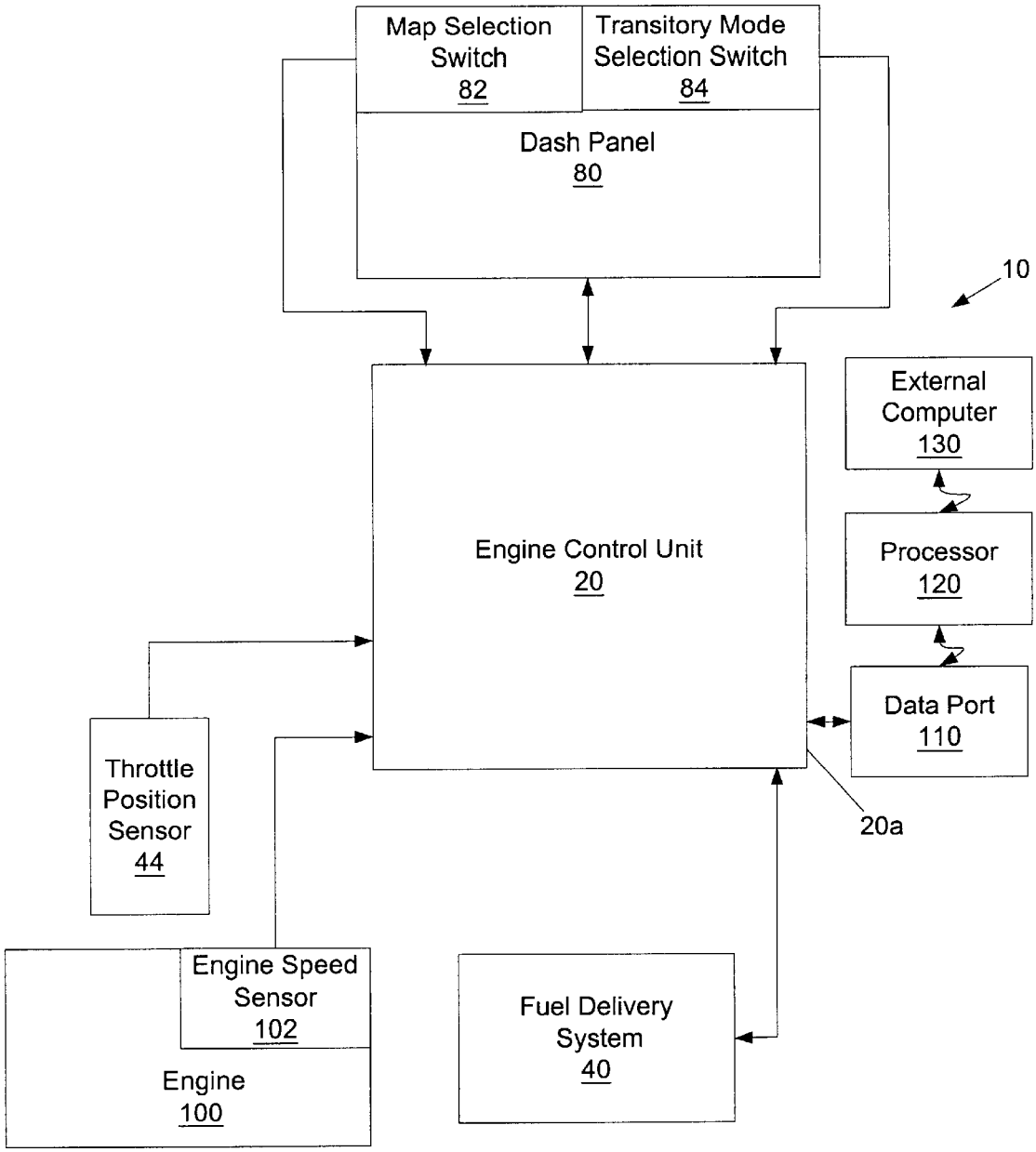
FIG. 1 is a schematic illustration of an embodiment of a system for calibrating engine operation.

FIG. 1 illustrates an embodiment of an engine management system 10 that includes a library of engine management files in an external computer 130. Those engine management files can be made available to an engine control system via a processor 120, and can be used for calibrating engine performance. The engine management system 10 includes an engine control unit 20 that is coupled (e.g., via wires, fiber, wirelessly, or other coupling device) to one or more input or output devices (e.g., sensors or actuators). The engine control unit 20 can include a processor 120 that uses coded instructions to act on one or more electrical input signals and to supply one or more electrical output signals. According to one embodiment, wires electrically connect the engine control unit 20 with various other components, which will be described in detail below. The engine control unit 20 may have a housing 20*a* mounted to a vehicle chassis through which other components can be electrically grounded with respect to the vehicle chassis (not shown), e.g., a motorcycle frame, in a known manner.

According to one embodiment, the engine control unit 20 can provide a single engine operating control value, i.e., for adjusting a single engine control, such as fuel quantity delivery. According to another embodiment, however, the engine control unit 20 can provide a plurality of engine operating control values, i.e., for controlling a plurality of engine controls, such as fuel quantity and ignition timing.

Figure 2:
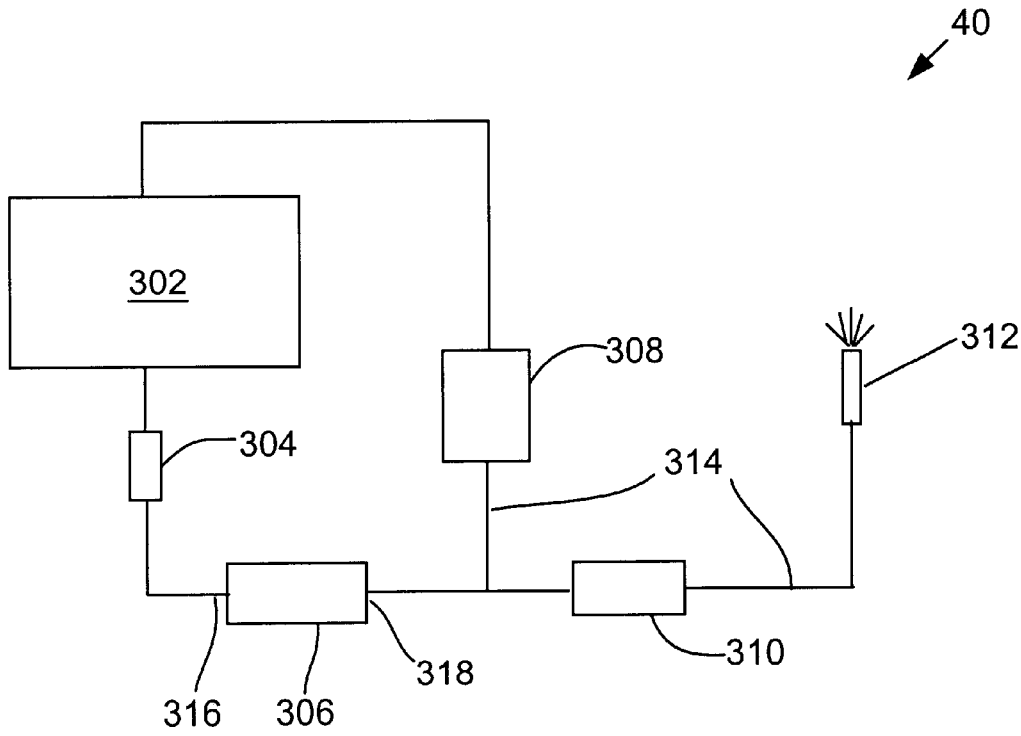
FIG. 2 is a schematic illustration of an embodiment of a fuel delivery system.

FIG. 2 illustrates an embodiment of a fuel delivery system 40 that may be utilized in connection with the present invention. The engine control unit 20 is electrically connected to the fuel delivery system 40 as illustrated in FIG. 1. The fuel delivery system 40 depicted includes a fuel tank 302, a coarse filter 304, a fuel pump 306, a pressure regulator 308, a fine filter 310, a fuel injector 312, and a fuel line 314. The fuel tank 302 contains a fuel, such as gasoline or diesel, for delivery to and consumption by the engine 100. The fuel line 314 may be, for example, a steel or stainless steel conduit in fluid communication with the fuel tank 302 and the fuel injector 312.

The coarse filter 304 may be located along the fuel line 314 to remove large contaminants from the fuel as the fuel travels from the fuel tank 302 to the fuel pump 306. The fuel pump 306 may also be located in the fuel line 314 between the fuel tank 302 and fuel injectors 312. The fuel pump 306 may alternately be placed elsewhere, such as in the fuel tank 302. The fuel pump 306 typically creates a pressure differential in the fuel line 314 between a pump inlet 316 and a pump outlet 318, thus transporting fuel from the fuel tank 302 through the fuel line 314 and in-line components and, ultimately, through the fuel injector 312. The fuel pump 306 can be electrically interconnected with the engine control unit 20, and may be, for example, a positive displacement type pump or a dynamic type pump.

The pressure regulator 308 measures differential pressure in the fuel line 314 and may be piped in fluid communication with the fuel tank 302 and the pump outlet 318. The pressure regulator 308 may control operation of the fuel pump 306 to maintain the pressure differential at a desired level. The pressure regulator 308, in one embodiment, relieves excess pressure by returning a portion of the high-pressure fuel stream to the fuel tank 302. The pressure regulator 308 may alternately or in addition be interconnected with the engine control unit 20, providing an input signal to the engine control unit 20, such that the engine control unit 20 may control operation of the fuel pump 306 to maintain a desired fuel differential pressure. The fine filter 310 may be located in the fuel line 314 between the fuel pump 306 and the fuel injector 312 to remove small particles of contaminants remaining in the fuel which might otherwise become lodged in the fuel injector 312. The fuel injector 312 atomizes the fuel and sprays the fuel toward one or more cylinders 362 as required. The fuel injector 312 can be oriented so as to spray a precisely metered amount of fuel toward, for example, an intake port in a two-stroke engine or an inlet tract 352 in a four-stroke engine. In the case of four-stroke engine designs having a plurality of intake valves, each of the fuel injectors 312 can be oriented so as to spray fuel into an inlet tract 352 for a single valve as illustrated in FIG. 3 or a fuel injector 312 may provide fuel to multiple intake valves.

Figure 3:
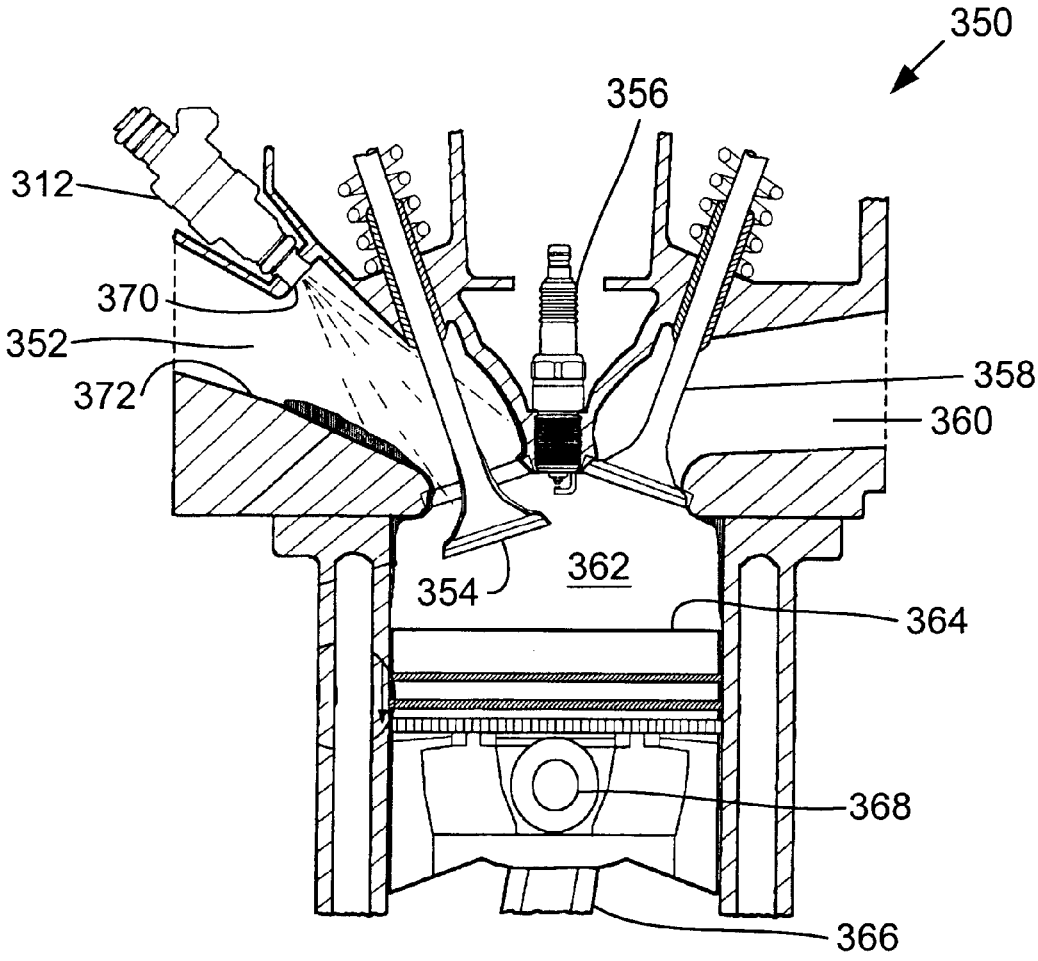
FIG. 3 is a cross-sectional view of an embodiment of a cylinder in a four-stroke engine.

FIG. 3 illustrates an embodiment of a cylinder of a four-stroke engine 350 that may be utilized in connection with the present invention. It will be recognized that other cylinder configurations may be utilized with the present invention including, for example, two-stroke engines and configurations in which a fuel injector 312 supplies fuel to either one or multiple cylinders 362. The embodiment of FIG. 3 includes a fuel injector 312, an inlet tract 352, an inlet valve 354, a spark plug 356, an exhaust valve 358, an exhaust tract 360, the cylinder 362, and a piston 364 attached to a crankshaft (not shown) via a connecting-rod 366 and a bearing 368.

Pressurized fuel from the fuel line 314 illustrated in FIG. 2 is sprayed through a nozzle 370 of the fuel injector 312 when a valve, such as an electrically operated solenoid valve (not shown), is opened permitting fuel to flow through the fuel injector 312. That valve may be an electrically operated solenoid valve that is actuated through an output of the engine control unit 20. Control of such a solenoid valve is usually performed by pulse width modulation such that a longer opening duration will provide more fuel into the cylinder or cylinders 362 supplied by the fuel injector 312. A butterfly valve may be positioned to permit airflow into the inlet tract 352 of one or more cylinders 362. The butterfly valve may be pivotal about an axis between a first position preventing airflow into the inlet tract 352 and a second position permitting airflow into the inlet tract 352. An actuator cam (not shown) may be connected to the butterfly valve for pivoting the butterfly valve against the bias of a return spring, e.g., a torsion spring, from the first position to the second position. The actuator cam can be connected, via a throttle cable (not shown), to an operator controlled throttle control element (not shown). Alternately, the actuator cam may be controlled by an output of the engine management system 10 and the throttle control element may serve only as an input to the engine management system 10. A throttle position sensor 44, as illustrated in FIG. 1, may, for example, be connected to the butterfly valve for measuring the angular position of the butterfly valve as it is pivoted about the axis, and/or may be connected to a throttle control element for input to the engine management system 10.

Fuel is typically permitted to flow through the inlet valve 354 to the cylinder or multiple cylinders 362. The inlet valve 354 then closes and the fuel is ignited by the spark plug 356, thereby driving the piston 364 away from the inlet valve 354 and outlet valve 358. The exhaust valve 358 opens as the piston 364 moves back toward the inlet valve 354 and exhaust valve 358, thereby forcing exhaust gases out of the cylinder 362, through the exhaust valve 358 and away through the exhaust tract 360.

It should be noted that fuel delivered to the cylinder 362 often passes through an inlet tract 352 where the fuel may be mixed with an oxidant, such as air, drawn through the inlet tract 352. Liquid fuel may thus build-up on a wall 372 of the inlet tract 352 or on the back of the inlet valve 354. Fuel may be delivered both during the approximately one-quarter cycle of a cylinder 362 in a four-stroke engine 350 when the inlet valve 354 is in an open position and during much of the three-quarters of a cycle when the inlet valve 354 is in a closed position when the engine is under high load. Thus, substantial build-up may occur on the inlet tract walls 372 and on the intake valve 352, and in the airstream present in the inlet tract 352, particularly under such high load engine conditions. The present invention is directed, in part, to compensating for lean operation when fuel, intended to be delivered to the cylinder 362, instead remains in the inlet tract 352, or rich operation when fuel from the inlet tract 352 is provided to the engine 100 in addition to fuel provided by the fuel injector 312.

The engine control unit 20 may be electrically connected to a dash panel 80 that is described in U.S. Pat. No. 6,539,299. As the engine management system 10 is shown in the figures, the engine control unit 20 supplies a signal controlling fuel quantity. It should be recognized, however, that additional control signals, for example controlling ignition timing, may also be provided by the engine control unit 20. In general, a map set can include different numbers of maps (i.e., fuel timing, power jet applications, or power valve actuation), or different combinations of map types (e.g., ignition timing, fuel timing, and power valve actuation).

Table 1 shows an example of a map that includes an arbitrarily selected number of steady-state fuel quantity setpoints. Fuel quantity setpoints typically vary from one engine to any other engine, thus optimum fuel quantity setpoints are calibrated uniquely for each engine 100. Fuel quantity setpoints also generally vary for any particular engine 100 depending on the operating characteristic to be optimized, i.e., maximum power, minimum fuel consumption, emission regulations, etc.

An engine state may be defined by measuring the value of one or more operating characteristics of an engine. It is common practice in engine management that engine speed and load are used to define a two-dimensional plane of engine operating states. It is also common for a controlled value such as engine fueling to be measured for a finite number of operating states. Thus, a map may include fuel values corresponding to known engine states. In a two-dimensional map having a measurable characteristic corresponding to engine load as a first axis and a measurable characteristic corresponding to engine speed as a second axis, a particular engine state may be defined as the intersection of the current engine load and current engine speed on the plane of the map.

Thus, the operating state of an engine 100 may be determined in many ways including measuring the speed of rotation of the engine 100 and the load on the engine 100. Engine speed is usually expressed in units of revolutions-per-minute or rpms. Engine load may be sensed by a variety of sensors including, for example, a throttle position sensor 44, a manifold vacuum sensor (not shown), or a mass airflow sensor (not shown) positioned to sense air flowing into one or more cylinders 362. The present invention also contemplates utilizing air mass per cycle delivered, or to be delivered, to an engine 100 or cylinder 362 to sense engine load. Each setpoint in Table 1 corresponds to the values of two engine operating characteristics, i.e., an engine speed value and an engine load value. Thus, for a given value of engine speed (e.g., as sensed by or derived from an output signal from a crankshaft angular motion sensor 102 coupled to an engine 100) and for a given value of engine load (e.g., as measured by the throttle position sensor 44), fuel quantity setpoints are assigned in a map and may be read therefrom. For example, the map illustrated in Table 1 causes the engine control unit 20 to deliver twenty-five grams of fuel per cycle at 2000 revolutions per minute (rpm), when the throttle is opened 50%. At 5000 rpm, when the throttle is fully open, the engine control unit 20 will vary fuel delivery to provide fifty grams of fuel per cycle. Thus, when either the engine load (e.g., throttle position) or engine speed changes, the fuel delivery system 40 will determine an initial, steady-state amount of fuel that is to be delivered at the new speed and load by reference to the map.

TABLE 1

| Fuel Delivery (milligrams per cycle | | Engine speed (revolutions per minute) 1000 | 2000 | 5000 | 7000 |
|---|---|---|---|---|---|
| Load | 5 | 7 | 5 | 4 | 3 |
| (Percentage | 25 | 10 | 21 | 15 | 10 |
| Throttle | 50 | 15 | 25 | 37 | 30 |
| Opening) | 75 | 15 | 25 | 44 | 40 |
| | 100 | 15 | 25 | 50 | 45 |

In general, a map will include a great number of setpoints that can be assigned for small increments of measured value for each engine operating characteristic utilized in the map. If the operating state of the engine falls in a gap between specified values of the characteristics (e.g., in Table 1, there are gaps of 2000 rpm or more between the specified values for engine speed and 20% or more gaps in engine load), the engine control unit 20 can interpolate the operating control values between the two closest speed columns and two closest load rows or the equivalent thereto.

As illustrated in FIG. 1, engine management data including one or more map sets can be downloaded to the engine control unit 20 from a processor 120, either via a data port 110 or by "docking" the processor 120, which may be a palm-size computer, with the fixed portion 80*a* of the dash panel 80. Multiple maps may be downloaded to the engine control unit 20 to control different operating parameters and/or to optimize a single operating parameter for different situations or conditions. For example, a map that optimizes normal racing conditions, a map that optimizes engine operation during acceleration from a low speed, and a map that optimizes engine operation at high speed may each be loaded into the engine control unit 20. The operator may then select any one of the three loaded maps while operating the vehicle by, for example, moving a three-position map selection switch 82 coupled to the engine control unit 20. The operator may furthermore trim certain characteristics of each map through another interface, such as a knob or trim-up and trim-down buttons, for interfacing to the engine control unit 20.

Engines 100 have two types of modes of operation, steady-state modes and unsteady-state modes, commonly called transitory or transient modes. An engine 100 operates in a steady-state mode when the engine load and speed are constant with respect to time and in a transitory mode when either the engine load or speed varies with time. In other words, an engine 100 is operating in a transitory mode anytime engine operation shifts from one state to another. A transition may, therefore, correspond to a shift from any one position on a map to any other position on a map.

Maps are typically optimized for steady-state engine operation. Engines 100, however, are most often operated at varying speeds and loads. For example, the engine of a racing motorcycle may be continually changing its operating state because of changing track conditions, such as hills and turns, encountered on a typical racing track. Moreover, values such as the mass of fuel supplied to an engine, optimized for steady-state operation, are typically not optimum values for transitory operation. Thus, there is a need for a method and system that will optimize performance during transitions in engine operating states.

The present invention may also include an interface to the engine control unit 20 through which an operator may vary the operation of transitory fueling. For example, a three-position transitory mode selection switch 84 may be coupled to the engine control unit 20. That switch may have, for example, an upper position, a center position, and a lower position. The upper position may be optimized for fastest engine response. The center position may be optimized for normal operation, which may, for example, be more comfortable for an operator or provide more stable operation of the vehicle. The lower position may be optimized for operation under slippery conditions. Of course, optimization for any condition and any number of transitory modes may be possible depending on the needs of an operator and/or vehicle.

Transitory modes may, furthermore, be tied to an individual map. Thus, different transitory control modes may operate for each map contained within the engine control unit 20. The engine control unit 20 may contain three fueling maps having three modes of transitory compensation that are unique to each map and the transitory mode selection switch 84 may be utilized to select one of three transitory modes related to the map selected by the map selection switch 82.

The coupling between the processor 120 and either the data port 110 or the fixed portion 80*a* can be via wires or wireless. In addition to the operation of the engine control unit 20 described above, the engine control unit 20 can operate smart lights and perform other functions as desired.

In addition to processing downloaded data, the engine control unit 20 can also be connected to any necessary on-board sensor. For example, an air-temperature sensor (not shown) and/or barometric pressure sensor (not shown) can provide sensor signals that can in turn be used to calculate the density of the air being inducted into the engine 100. Because the displacement of an engine is typically constant and mass of combustion air is equal to the displacement times the density of the combustion air, the mass of combustion air may be calculated. Thus, inlet temperature and pressure can be used to affect global changes to all control signals based on the values in each map set that has been downloaded to the engine control unit 20. Thus, a map may include fuel mass requirements under standard atmospheric conditions and the engine control unit 20 may compensate for various atmospheric pressures and/or temperatures, which effect air density and air mass per engine cycle.

In connection with this invention, the expression "global" refers to making an adjustment with respect to every setpoint in a control map, whereas "local" refers to a setpoint or a group of setpoints in a control map. The sensor signals from the engine speed sensor 102 and throttle position sensor 44, in addition to being monitored by the engine control unit 20 for accessing setpoints, can be used to determine which setpoints are to be the basis for trimming. Using the engine management system 10 in connection with the fuel delivery system 40 including fuel injectors 312 can furthermore be considered to be analogous to carburetor jetting, i.e., below a certain throttle opening, local trimming according to the present invention corresponds to changing the slow jet, local trimming at higher throttle openings corresponds to changing the needle jet, and local trimming at still higher throttle openings corresponds to changing the main jet.

Additionally, a sensor (not shown) for electrical system voltage can measure variations that directly affect the reaction time and accuracy of the electromechanical movements within the fuel injectors 312. Sensors (not shown) for gear position and side stand deployment can be used to alert a user, such as a motorcycle rider, to potentially harmful or dangerous conditions and a sensor (not shown) for detecting the initiation of a gear change can signal the engine control unit 20 to momentarily cut-off the ignition system or fuel delivery, thereby facilitating smoother shifts. Of course, the engine control unit 20 can be connected to many other sensors, e.g., sensors (not shown) for engine coolant temperature or oil pressure that can provide a warning to the engine operator or control of the engine 100.

It is believed that fuel flowing into the cylinders 362 of fuel injected engines comes not only from the fuel injectors 312 but also from collateral sources including one or more walls 372 of any inlet tract 352 extending from the fuel injector 312 to the cylinder 362, surfaces of the inlet valve 354 and the airstream in the inlet tract 352. It is furthermore believed that when fuel delivery is not at a steady-state, for example, during acceleration or deceleration, or increasing or decreasing load, the quantity of fuel delivered by those collateral sources varies. For example, when the throttle is opened quickly, fuel delivered from the inlet tract 352 may be reduced because of greater pressure in the inlet tract 352 causing the engine 100 to run lean during that period of acceleration. Similarly, when the throttle is closed quickly, the delivery of fuel from the walls 372 of the inlet tract 352 may increase causing the engine 100 to run rich.

The present invention calculates necessary fuel delivery under transitory throttle conditions and compensates for changes in fuel delivered from collateral sources by varying fuel flow from the injectors during transitory engine operation. In one embodiment, the present invention senses engine speed and throttle position and reads or interpolates an associated quantity of fuel from a look-up table or map that is to be delivered to each cylinder 362 every engine cycle.

Quantity of fuel is expressed in the examples that follow, as a fuel mass per cycle to be delivered. It should be noted that fuel mass delivered per cycle may decrease as engine speed increases, however, the rate of fuel delivery per time unit such as per second will increase because of increased frequency of injection. The values retained within the map may, however, be expressed in terms other than fuel quantity or mass. For example, the value saved in the map may be an amount of time that an injector should be held open to deliver a desired quantity of fuel in, for example, a pulse width modulated system. The value may also correspond to fuel pressure, AFR, or a degree of injector opening, for example.

When an engine is operating at a steady-state, the fueling requirements are the same for each consecutive engine cycle. Engines may furthermore be operated at various steady-states in a laboratory and optimum fuel delivery may be determined by stepping the engine along its operating range. Thus, the fuel mass to be delivered for any steady-state operation may be easily determined and included in a map. Engines, however, typically transition from one operating state to another during use and the mapped steady-state fuel quantity is typically not optimized for such transitional operation. Moreover, an engine may transition in a nearly infinite number of ways. During a transition, engine speed and load may change separately or together in a wide variety of combinations. Thus, mapping transitional calibration values would be very time consuming and difficult. In contrast, the present invention provides a general purpose method to accomplish transient fueling calibration that recognizes changes in the state of operation of an engine and compensates for transitions by changing fuel delivery based on the sensitivity of the engine to changing states and the amount of change reflected in a steady-state fuel calibration map or table for the engine.

Thus, the present method may begin by retrieving the steady-state fuel value from a map for the current operating state. The steady-state value may then be compared to a previous steady-state value to determine an amount of change in the steady-state fueling requirements. If a change in steady-state requirement occurs, the method will adjust the fuel quantity to compensate for the transition.

The fuel delivery system 40 of the present invention will calculate a transient fuel differential, which is an amount of fuel that should be added to or subtracted from the current steady-state amount of fuel determined from the map. That determination may be accomplished by, for example, reading from the map or interpolating from values on the map. That transient fuel differential alters the amount of fuel that would be delivered by the map only, compensating for collateral fuel loss or gain due to the transition taking place and other transitory needs of the engine. That transient fuel differential may be expressed as a positive value where fuel is to be added and a negative value when fuel is to be subtracted from the steady-state fuel quantity determined from the map. A minimum amount of fueling change may, furthermore, be required to surpass a noise threshold before adding the transient fuel differential to the steady-state fuel requirement. Such a threshold beneficially minimizes the effect of such things as a noisy speed signal or variations in throttle position caused by unintentional variations in pressure applied to the throttle by an operator.

In adjusting fuel quantity to compensate for an engine transition, the present method may consider a variety of factors including the sensitivity of the engine to fueling changes, the amount of the fuel change, duration or the number of engine cycles during which compensation should persist, and a decay rate for the compensation. Engine sensitivity may be a factor related to how much compensation a particular engine requires during transitions and may be expressed as a multiplier such as the factor "ETSF" in the equation hereinbelow. The amount of change in the operating state of an engine may be expressed in terms of a change in a steady-state fueling value for an engine, engine load, engine speed or one or more other sensed or calculated values that indicate the state of the engine. The equation included hereinbelow utilizes steady-state change in fuel mass per cycle, which is equal to the steady-state mass required for the next cycle less the steady-state mass that was required for the previous cycle, or "SSCM/C." The duration during which a transient fueling amount compensating for an engine state transition should be added may be expressed in terms of, for example, time or number of engine cycles. The duration may be as little as a single cycle such that utilizing a stack as described below is not necessary. Compensation over a duration may also be considered by use of Proportional and Integral "PI" or Proportional, Integral, and Derivative "PID" control strategies. It should be noted that in certain applications, including racing engines, transitions occur nearly every engine cycle, which may affect duration decisions. Decay is a rate of reduction of the amount of influence a single state change has as time passes. Decay may be a multiplier applied to the transitory mass of fuel each cycle or each unit of time to reduce the effect of past transitions.

In a certain embodiment, the transient fuel differential is equal to the sum of a stack of values stored in a data storage facility such as RAM. The values that are stored in the stack may be calculated by multiplying an engine transition sensitivity factor, which may be determined separately through experimentation for each engine to be controlled, by an engine requirement differential. The engine requirement differential may be equal to the difference between the steady-state fuel requirement to be delivered next and the steady-state fuel requirement that was to be delivered previously. For example, the engine requirement differential may be equal to a fuel mass determined from the map for the current throttle position and engine speed less the fuel mass delivered in the last cycle. That value may then be entered into a first position in the stack. Notably, the engine requirement differential may be calculated for each cycle of each cylinder 362. Thus, the value entered into the first position of the stack may be calculated as follows:

$$TM/C=ETSF*SSCM/C$$

Where:

TM/C is the transient mass of fuel per cycle or transitory fuel differential;

ETSF is the engine transition sensitivity factor; and

SSCM/C is the steady-state change in fuel mass per cycle, which is equal to the steady-state mass required for the next cycle less the steady-state mass that was required for the previous cycle.

It will be recognized that, when the next steady-state mass of fuel requirement is less than the previous steady-state mass of fuel requirement, the transient mass of fuel per cycle will be a negative amount. Conversely, when the current steady-state mass of fuel requirement is greater than the previous steady-state mass of fuel requirement, the transient mass of fuel per cycle will be a positive amount. In that way, compensation for both increases and decreases in fuel delivered from collateral sources is provided by the calculated transient mass of fuel per cycle.

Furthermore, the engine transition sensitivity factor may alternately be a non-linear function rather than a linear factor.

The stack may be any size and may be variable in size depending, for example, on engine operating state. In the following example, the stack contains storage locations for five fuel mass values. The first value in the stack is the calculated transitory fuel amount for a current fuel quantity transition. The remainder of the stack is utilized to factor a decay rate for the transitory fuel differential over four additional cycles. Thus, for a first cycle, a first transitory fuel differential is calculated and placed in the first storage area in the stack. Prior to the second cycle, that transitory fuel amount is removed from the first storage area, multiplied by a decay rate, and placed in the second stack storage area. For the third cycle, the value in the second storage area is removed, multiplied by the decay rate, and placed in the third stack storage area. Similarly, the value is removed from the third storage area, decayed, and placed in the fourth storage area and then removed, decayed, and placed in the fifth storage area prior to the fourth and fifth cycles, respectively. That transitory fuel amount is then removed from the fifth storage area and has no further effect on fuel mass delivery after the fifth cycle. Therefore, when a single fuel quantity transition occurs at least five cycles after the last transition, and no fuel quantity transitions occur for five cycles after that transition, only one non-zero amount will reside in the stack. Thus, the sum of the stack storage areas will be equal to the decaying fuel mass calculated from the single transition. The values in the stack are then totaled and added to the steady-state fuel mass associated with the current engine state to arrive at a mass of fuel to be delivered to, for example, the engine 100 or a particular cylinder 362 for the current cycle. Where one or more additional transitions occur within five cycles, multiple values will concurrently reside in the stack.

The decay may also be a non-linear function rather than a linear rate of decay.

TABLE 2

| 2a | 2b | 2c | 2d | 2e | 2f | 2g |
|---|---|---|---|---|---|---|
| 8 | 0 | -4 | 0 | 0 | 0 | 0 |
| 0 | 4 | 0 | -2 | 0 | 0 | 0 |
| 0 | 0 | 2 | 0 | -1 | 0 | 0 |
| 0 | 0 | 0 | 1 | 0 | -0.5 | 0 |
| 0 | 0 | 0 | 0 | 0.5 | 0 | -.25 |
| 8 | 4 | −2 | −1 | −0.5 | −0.5 | −0.25 |

Table 2 illustrates transitions occurring over seven cycles (a–g) of a cylinder 362. In that example, the decay rate will reduce the transitory fuel differential to one half of its previous value. The engine transition sensitivity factor in this example is 0.5. In a first cycle, illustrated in column 2a of Table 2, a transition occurs for which the steady-state change in fuel mass is 16 mg of fuel. Thus, the transitory fuel differential is equal to 0.5 times 16 mg, or 8 mg of fuel. Thus 8 is placed in the first stack position. As illustrated in column **2*b*, if no transition occurs in a second cycle, a zero is placed in the first stack position to correspond to a transitory fuel differential of zero and a four is placed in the second stack position to correspond to the 8 decayed by one-half. As illustrated in column 2c, if another transition occurs in a third cycle having a steady-state change in fuel mass of −8 mg, then the transitory fuel differetial is equal to 0.5 times −8 mg, or −4 mg of fuel. Thus, a −4 is placed in the first stack position, a 0 is placed in the second stack position, and a 2 is placed in the third stack position to correspond to the 8 that entered the stack in the first cycle decayed twice. As illustrated in column 2d, if no transition occurs in a fourth cycle, a zero is placed in the first stack position to correspond to a transitory fuel differential of zero, a −2 is placed in the second stack position to correspond to the −4 that entered the stack on the third cycle decayed by one-half, a 0 is placed in the third stack position, and a 1 is placed in the fourth stack position to correspond to the 8 that entered the stack in the first cycle decayed three times. As illustrated in column 2e, if no transition occurs in a fifth cycle, a zero is placed in the first stack position to correspond to a transitory fuel differential of zero, a zero is placed in the second position corresponding to the zero in the first position of the last cycle decayed, a −1 is placed in the third stack position to correspond to the −4 that entered the stack on the third cycle decayed twice, a 0 is placed in the fourth stack position, and a 0.5 is placed in the fifth stack position to correspond to the 8 that entered the stack in the first cycle decayed four times. After the fifth cycle, the decayed 8 mg transitory fuel differential will be removed from the stack and have no further effect on fuel mass to be delivered to the cylinder 362**.

As illustrated in column 2f, if no transition occurs during the sixth cycle, zeros are placed in the first through third stack positions, −0.5 is placed in the fourth position to correspond to the −4 that entered the stack on the third cycle decayed three times, and a 0 is placed in the fifth stack position. As illustrated in column 2g, if no transition occurs again during the seventh cycle, zeros are placed in the first through fourth stack positions and −0.25 is placed in the fifth position to correspond to the −4 that entered the stack on the third cycle decayed four times. Thereafter, the transitory fuel differential from the third cycle will have no further affect on the amount of fuel delivered.

Assuming that no transitions occurred in the 4 cycles prior to the first cycle described above, the total of the stack would be 8+0+0+0+0, or 8 mg for the first cycle and, thus, in addition to the steady-state fuel mass read from the map, an additional 8 mg of fuel would be supplied due to the transitory fuel differential. In the second cycle, 0+4+0+0+0, or 4 mg of fuel would be provided in addition to the steady-state fuel mass. In the third cycle, −4+0+2+0+0, or −2 mg of fuel would be added to compensate for transitory fuel needs. In the fourth cycle, 0+−2+0+1+0, or −1 mg of fuel would be provided in addition to the steady-state fuel mass. In the fifth cycle, 0+0+−1+0+0.5, or −0.5 mg of fuel would be added to compensate for transitory fuel needs. In the sixth cycle, 0+0+0+−0.5+0, or −0.5 mg of fuel would be added and in the seventh cycle, 0+0+0+0+−0.25, or −0.25 mg of fuel would be added to compensate for transitory fuel needs.

TABLE 3

| 3a | 3b | 3c | 3d | 3e | 3f | 3g |
|---|---|---|---|---|---|---|
| 8 | 0 | 0 | 0 | 0 | 0 | 0 |
| 0 | 4 | 0 | 0 | 0 | 0 | 0 |
| 0 | 0 | 2 | 0 | 0 | 0 | 0 |
| 0 | 0 | 0 | 1 | 0 | 0 | 0 |
| 0 | 0 | 0 | 0 | 0.5 | 0 | 0 |
| 8 | 4 | 2 | 1 | 0.5 | −0 | −0 |

In another embodiment, positive transitory fuel differentials are utilized but negative transitory fuel differentials have no affect on the mass of fuel delivered. Applying that embodiment to the seven cycles described hereinbefore, the transient fuel differential is the same for the first two cycles. Thus, as illustrated in columns 3a and 3b of Table 3, respectively, in the first cycle the transient fuel differential is 8+0+0+0+0, or 8 mg and 0+4+0+0+0, or 4 mg of fuel in the second cycle. As illustrated in column 3c, in the third cycle, the fuel quantity transition to a reduced engine operation state is not utilized to modify the mass of fuel to be supplied and, thus, 0+0+2+0+0, or 2 mg of fuel would be added to compensate for transitory fuel needs. As illustrated in column 3d, in the fourth cycle, 0+0+0+1+0, or 1 mg of fuel would be provided in addition to the steady-state fuel mass. As illustrated in column 3e, in the fifth cycle, 0+0+0+0+0.5, or 0.5 mg of fuel would be added to compensate for transitory fuel needs, and, as illustrated in columns 3f and 3g, respectively, in the sixth and seventh cycles, 0 mg of fuel would be added to compensate for transitory fuel needs.

In another embodiment of the present invention, the engine transition sensitivity factor and the decay rate are separate parameters that may be set differently for transitions requiring additional fuel than are the engine transition sensitivity factor and the decay rate for transitions requiring a reduction in fuel. Moreover, when a negative transition requiring a reduction in fuel follows one or more positive transitions requiring an addition in fuel, all values remaining in the stack from positive transitions are zeroed. Similarly, when a positive transition requiring an addition in fuel follows one or more negative transitions requiring a reduction in fuel, all values remaining in the stack from negative transitions are zeroed. Thus, for example, in a deceleration, positive transients are eliminated so that the engine can decelerate as desired without earlier positive transients to reduce the degree of desired deceleration.

Furthermore, a range, such as a hysteresis band, may be set around a zero transitory fuel requirement. That hysteresis band might be utilized to eliminate the effect of a small transition in fuel requirement from a previous cycle which might be due, for example, to noisy signals or small variations in engine operation state or operator input that are not intended to zero transitory fuel. Transitions occurring in that range would not zero values remaining in the stack from previous cycles so that transitory fueling will remain in effect when small transitions occur in the opposite direction. Transitions occurring within the hysteresis band may, furthermore, trigger placement of a zero in the stack for the cycle during which that transition occurs. Alternately, only a transition falling within the hysteresis band that is in the same direction as the most recent transition will trigger a non-zero value to be included in the stack for the applicable cycle.

TABLE 4

| 4a | 4b | 4c | 4d | 4e | 4f | 4g |
|---|---|---|---|---|---|---|
| 0 | 0 | -2 | 0 | 0 | 0 | 0 |
| 2 | 0 | 0 | -1 | 0 | 0 | 0 |
| 0 | 1 | 0 | 0 | -0.5 | 0 | 0 |
| 0 | 0 | 0 | 0 | 0 | -.25 | 0 |
| 0 | 0 | 0 | 0 | 0 | 0 | -.13 |
| 2.0 | 1.0 | −2.0 | −1.0 | −0.5 | −0.25 | −0.13 |

Table 4 illustrates an example of the present invention in which the engine transition sensitivity factor for positive steady-state fuel changes is 0.5 and the engine transition sensitivity factor for negative steady-state fuel changes is 0.2. In the example illustrated in Table 4, the decay rate is 0.5 for both positive and negative transitions and zeroing is implemented when alternating positive and negative steady-state transitions occur. Furthermore, a hysteresis band from −2 mg to +2 mg is applied so that any change in steady-state requirement that is greater than or equal to −2 mg and follows a positive transition that has a remnant in the stack will not zero the positive transition from the stack and any change in steady-state requirement that is less than or equal to 2 mg and follows a negative transition that has a remnant in the stack will not zero the negative transition from the stack. All transitions in the hysteresis band in this example will, furthermore, trigger placement of a zero in the stack for that cycle. The example illustrated in Table 4 permits a transitory fuel differential to decay for five cylinder cycles from the cycle at which the transition occurs and then discards any remnant of a transition after the fifth cycle. Thus, for example, when a positive transition has occurred in the last five cycles, and a negative transition of greater than or equal to −2 mg occurs, the positive transition remnant in the stack will remain in the stack and a zero value will be placed in the stack corresponding to the cycle in which the small negative transition occurred.

In a first cycle illustrated in column 4a of Table 4, no transition occurs, however a remnant from a positive transition that occurred in the previous cycle resides in the second stack position. In a second cycle illustrated in column 4b of Table 4, a negative transition of −1 mg occurs. That transition falls within the hysteresis band and so initiates entry of a zero in the stack for that cycle while permitting the positive remainder from the positive transition to remain in the stack. Thus, a zero is placed in the first memory area of the stack for the second cycle. The positive transition is decayed by multiplying the value in the second memory area of the stack by the decay rate of 0.5 and placing a 1.0 in the third memory area of the stack. All other memory areas of the stack are filled with zeros to correspond to the lack of transitions during those cycles.

In a third cycle illustrated in column 4c of Table 4, a negative steady-state transition of −10 mg occurs. Thus, −10 is multiplied by the negative transition factor of 0.2 to arrive at a value of −2 to be placed in the first stack location. The zero value from the transition that occurred in the second cycle carries into the second stack location. The third stack location is set at zero to correspond to the lack of transition during the first cycle. The fourth stack location is also zeroed because the current negative transition is outside the hysteresis band, thus causing the positive transition to be zeroed. The fifth stack location is also zeroed to correspond to no transition occurring during the corresponding cycle. In the fourth through seventh cycles, which are illustrated in columns 4d–4g of Table 4, no additional transitions occur and the values that entered during the transitions of the second and third cycles are shown decaying through the stack.

In the various embodiments of the present invention, the sum of the stack will appropriately account for the multiple transitions. When a decay multiplier of less than one is applied in the equation, the earliest transitions using such a decay factor will decay more than later transitions, so than more recent transitions have a greater effect on the mass of fuel delivered. Thus, the stack also appropriately accounts for the proximity in time of each transition when an appropriate decay factor is applied.

Figure 4:
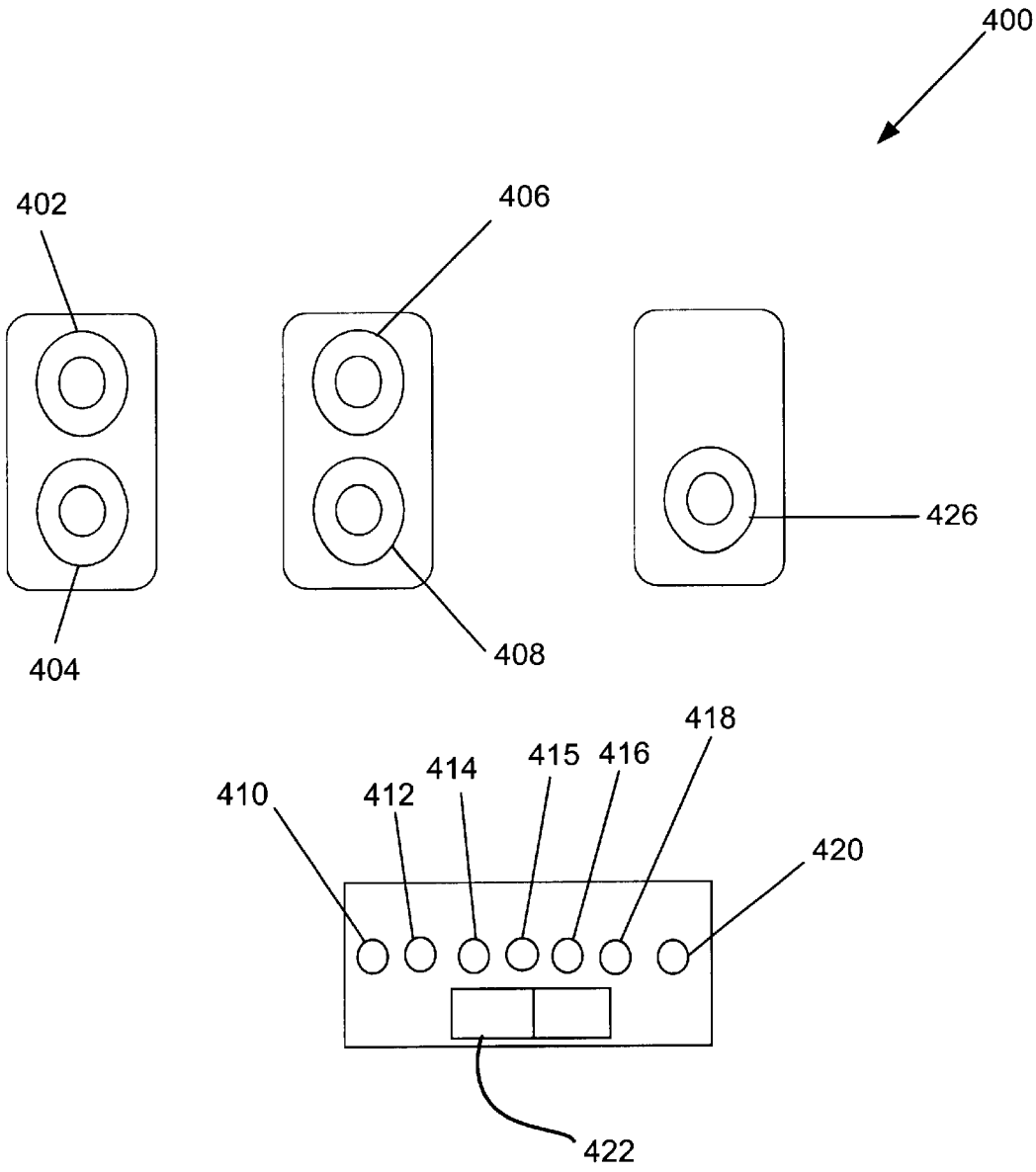
FIG. 4 illustrates an embodiment of a system by which a vehicle operator may trim engine operating characteristics.

FIG. 4 illustrates a system by which a driver or rider of a vehicle may adjust or "trim" engine operating characteristics including transient fueling. The embodiment illustrated is a grouping of input and output devices that constitute a rider trim system 400 for attachment to one or more handlebars of a vehicle. An operator is provided with information regarding vehicle performance through indicators and is able to modify operation through input devices. The input devices may be analog devices such as potentiometers or binary devices such as switches, buttons, or general contact based devices.

The rider trim system illustrated in FIG. 4 includes a kill switch 402, a map select switch 404, a trim up switch 406, a trim down switch 408, a system power indicator 410, a diagnostic indicator 412, an engine temperature indicator 414, a transient trim enable/disable indicator 415, a first map indicator 416, a second map indicator 418, a third map indicator 420, a display 422 and a trim defeat switch 426. Those switches may have dual functionality such that certain switches may be selectively activated to trim map, set point, and transient operation. The switches will be described herein, however, only in connection with trimming transient fueling.

The kill switch 402 will stop engine operation when activated and is typically intended as an operator initiated emergency shut-down system. The map select switch 404 may be operated to alternately activate an assortment of maps to vary performance of the engine 100. Furthermore, because each map may include transient operating parameters, only the parameters of the selected map are adjusted by the trim up and trim down switches 406 and 408.

The trim up and trim down switches 406 and 408 may be assigned, by way of a trim definition setup, to trim any engine operating characteristic. Those engine operating characteristic may include transient control parameters individually or in combination. Such transient control parameters include, for example, the positive engine transition sensitivity factor, the negative engine transition sensitivity factor, the positive decay rate, the negative decay rate, the duration for which a positive transition will affect fueling and the duration for which a negative transition will affect fueling. Moreover, while engine trimming may be performed when the engine 100 is not operating, it may also be performed in a particularly beneficial manner while the engine 100 is operating.

In a certain embodiment, the trim up and trim down switches 406 and 408 are defined to adjust both the positive and negative engine transition sensitivity simultaneously. That approach provides a very simple yet powerful transient calibration tool. For example, where a trim factor of one is set initially, by depressing the trim up switch 406 one time, the trim factor may be increased to 1.2. Each time the trim up switch 406 is depressed thereafter, the transitory fuel differential will be increased by 0.2 up to a limit set in a transitory fuel trim definition. Likewise, each time the trim down switch 408 is depressed the transitory fuel differential will be decreased by 0.2 until a limit set in the transitory fuel trim definition or zero is reached. The calculated transitory fuel differential may also be limited to a minimum of zero. When the trim up switch 406 is depressed once, for example, and the transitory fuel differential is 2.5 mg, the amount of transitory fuel delivered to the engine would be 2.5 mg times 1.2 or 3 mg. Similarly, when the trim up switch 406 is depressed once and the transitory fuel differential is −2.5 mg, the amount of transitory fuel delivered to the engine would be −2.5 mg times 1.2 or −3 mg. When the trim down switch 408 is depressed once in that example, and the transitory fuel differential is 2.5 mg, the amount of transitory fuel delivered to the engine would be 2.5 mg times 0.8 or 2 mg. Similarly, when the trim down switch 408 is depressed once and the transitory fuel differential is −2.5 mg, the amount of transitory fuel delivered to the engine would be −2.5 mg times 0.8 or −2 mg. The trim defeat switch 426 permits an operator to alternate between one or more settings created by use of the trim switches 404, 406, and 408 and one or more original untrimmed settings. The trim defeat switch may thus operate as an A-B-A switch to permits alternation between the trimmed settings and the original settings and back again with each operation of the switch.

The display lights 410, 412, 414, 415, 416, and 418 illuminate to indicate certain engine conditions to the operator and the display 422 is utilized to display pertinent information to the operator. The first map indicator 416 may illuminate to indicate that a first preprogrammed steady-state map has been selected with the map select switch 404. Similarly, the second map indicator 416 may illuminate to indicate that a second preprogrammed steady-state map has been selected with the map select switch 404 and the third map indicator 416 may illuminate to indicate that a third preprogrammed steady-state map has been selected with the map select switch 404. The transient trim enable/disable indicator 415 may illuminate when trimming is enabled and dark when trimming is disabled by operation of the trim defeat switch 426.

Thus, the engine management system 10 provides many advantages including calibrating engine performance with adjustments that can be made while the engine 100 is being operated in its intended environment, and enabling adjustments to delivered fuel quantity to compensate for transitions in state of engine 100 operation.

The embodiments of the engine management system 10 can be provided for internal combustion engine powered land traversing vehicles, watercraft, and flying vehicles, and thus, include automobiles, trucks, motorcycles, all-terrain vehicles, snowmobiles, boats, personal watercraft, and airplanes.

The embodiments described above are examples of the present apparatus and method for trimming an engine management system 10 whereby a number of advantages are achieved.

Those advantages include allowing engine operation to be calibrated during continuous operation in the engine's intended environment and improving operation of an engine 100 when the engine operating state changes, for example, during acceleration or deceleration of the engine 100. For example, the performance of a race engine can be improved by preventing lean operation during acceleration. Moreover, engine performance can be modified within particular user defined ranges of engine performance.

While the present invention has been disclosed with reference to certain embodiments, numerous modifications, alterations, and changes to the described embodiments are possible without departing from the scope of the present invention, as defined in the appended claims. Accordingly, it is intended that the present invention not be limited to the described embodiments, but that it have the full scope defined by the language of the following claims, and equivalents thereof.

What is claimed is:

1. A method of adjusting a quantity of fuel delivered to an engine when at least one of engine speed and engine load transitions, comprising:

determining a current steady-state quantity of fuel to be delivered to the engine; and adding a transitory quantity of fuel, based on a change from a previously determined quantity of fuel to the current steady-state quantity of fuel, to the current steady-state quantity of fuel for a period of time following initiation of the transition in at least one of engine speed and engine load.

2. The method of claim 1, wherein the transitory quantity of fuel is negative.

3. The method of claim 1, wherein the transitory quantity of fuel is set to zero when a negative transitory quantity of fuel is calculated.

4. The method of claim 1, wherein delivering a quantity of fuel further comprises delivering the quantity of fuel to a cylinder of the engine.

5. The method of claim 1, wherein the quantity of fuel is delivered to more than one cylinder of the engine.

6. The method of claim 1, wherein the fuel quantity is expressed in terms of a period of time during which a valve is open for fuel to pass therethrough.

7. The method of claim 1, wherein the period of time following initiation of the transition is the time required for a predetermined number of cycles to occur.

8. The method of claim 7, wherein the predetermined number of cycles is a predetermined number of cycles of the engine.

9. The method of claim 7, wherein the predetermined number of cycles is a predetermined number of cycles of a piston in a cylinder.

10. The method of claim 1, wherein the transitory quantity of fuel changes during the period of time following initiation of the transition.

11. The method of claim 10, wherein the transitory quantity of fuel decays during the period of time following initiation of the transition.

12. The method of claim 11, wherein the transitory quantity of fuel decays at a predetermined rate.

13. The method of claim 1, wherein the transitory quantity of fuel has no effect on the quantity of fuel delivered after the predetermined period of time expires.

14. The method of claim 1, wherein the engine load transition includes a change of throttle position.

15. The method of claim 1, wherein the transition includes a change in engine speed and a change in engine load.

16. The method of claim 1, wherein the fuel is to be delivered to the engine.

17. The method of claim 1, wherein the previously determined quantity of fuel is a quantity of fuel that was previously calculated to be delivered.

18. The method of claim 1, wherein the previously determined quantity of fuel is an actual quantity of fuel that was delivered.

19. The method of claim 1, wherein the previously determined quantity of fuel is a steady-state quantity of fuel that would have been delivered if a transitory quantity of fuel had not been added thereto.

20. The method of claim 1, whereby determining a steady-state quantity of fuel to be delivered to the engine includes retrieving the steady-state quantity of fuel from a table.

21. The method of claim 20, whereby determining a steady-state quantity of fuel to be delivered to the engine further includes interpolating the steady-state quantity of fuel from the table.

22. The method of claim 1, wherein the steady-state quantity of fuel is determined by reference to a map.

23. The method of claim 1, wherein the transitory quantity of fuel is based on a non-linear function of a the difference between the previously determined quantity of fuel and the current steady-state quantity of fuel.

24. The method of claim 1, wherein the transitory quantity of fuel is calculated by applying an engine sensitivity factor to a the difference between the previously determined quantity of fuel and the current steady-state quantity of fuel.

25. The method of claim 24, wherein the sensitivity is a non-linear function.

26. The method of claim further comprising manipulating a device that adjusts a trim factor, wherein the trim factor varies the engine sensitivity factor.

27. The method of claim 24, wherein a decay factor is applied to the transitory quantity of fuel each subsequent engine cycle.

28. The method of claim 27, wherein the decay is a non-linear function.

29. The method of claim 24, wherein the transitory quantity of fuel for a given transition in engine state affects the quantity of fuel delivered to the engine for a duration equal to a predetermined number of cycles.

30. The method of claim 29, wherein the transitory quantity of fuel for a given transition in engine state does not affect the quantity of fuel delivered to the engine after the predetermined number of cycles.

31. The method of claim 29, wherein the duration is a variable number of cycles.

32. The method of claim 1, wherein the transitory quantity of fuel is further based on an operator manipulated device.

33. The method of claim 32, wherein the operator manipulated device is manipulated during operation of the engine.

34. A method of adjusting a transitory quantity of fuel delivered to an engine when an engine operating state transitions, comprising:

determining a current steady-state quantity of fuel to be delivered to the engine;

calculating an initial transitory quantity of fuel by applying an engine sensitivity factor to a difference between a previously determined quantity of fuel and the current steady-state quantity of fuel;

manipulating a trim device that varies a trim factor;

calculating a trimmed transitory quantity of fuel by applying the trim factor to the initial transitory quantity of fuel;

actuating a trim defeat device that alternates between an enable trim mode and disable trim mode when actuated;

setting the transitory quantity of fuel equal to the initial transitory quantity of fuel when trim mode is disabled; and setting the transitory quantity of fuel equal to the trimmed transitory quantity of fuel when trim mode is enabled.

35. The method of claim 34, further comprising retaining the trim factor in a memory device.

36. The method of claim 35, further comprising retrieving the trim factor from the memory device.

37. The method of claim 34, wherein the trim factor is non-linear.

38. An engine fuel control apparatus, comprising:

a processor coupled to an output and a memory, whereby the memory contains fuel delivery data and instructions which, when executed by the processor, cause the processor to:

determine a current steady-state amount of fuel to be delivered by reference to the fuel delivery data;

add a transitory quantity of fuel, based on a change from a previously determined quantity of fuel to the current steady-state amount of fuel to be delivered, to the current steady-state amount of fuel to be delivered for a period of time following initiation of the transition; and apply a signal corresponding to that amount of fuel to the output;

a fuel supply device; and a fuel supply actuator coupled to the output of the processor and operably coupled to the fuel supply device to control fuel flow therethrough.

39. The apparatus of claim 38, wherein the change from the previously determined quantity of fuel to the current steady-state amount of fuel to be delivered is caused by a change in at least one of engine speed and engine load.

40. The apparatus of claim 39, wherein the change in engine load includes a change in throttle position.

41. An engine fuel control apparatus, comprising:

a processor having an input and an output, whereby a signal corresponding to a steady-state amount of fuel plus a transitory amount of fuel based on a change from a previously determined amount of fuel to the steady-state amount of fuel, is incident on the output;

a fuel supply device; and a fuel supply actuator coupled to the output of the processor and operably coupled to the fuel supply device to control fuel flow therethrough.

42. The apparatus of claim 41, wherein the fuel supply device includes a fuel injector.

43. The apparatus of claim 41, wherein the fuel supply device includes a carburetor.

44. The apparatus of claim 41, further comprising an operator actuated input device coupled to said processor input, whereby actuation of the input device adjusts the transitory amount of fuel to be provided to the engine.

45. The apparatus of claim 44, wherein the input device is manipulated by an operator of a vehicle driven the engine.

46. The apparatus of claim 44, wherein the input device is a potentiometer.

47. The apparatus of claim 44, wherein the input device includes a trim up contact and a trim down contact.

48. The apparatus of claim 47, wherein the trim up contact increments transitory fuel quantity delivered and the trim down contact decrements transitory fuel quantity delivered.

49. The apparatus of claim 48, further comprising a trim defeat contact that alternates transitory fuel quantity delivered between a base fuel amount that is unaffected by the input device and a trimmed fuel amount that is affected by the input device.

50. A method of adjusting an amount of fuel to be provided to an engine during a transition in engine state, comprising:

determining a steady-state quantity of fuel to be delivered to the engine;

calculating a transitory quantity of fuel to be delivered to the engine;

manipulating a device that adjusts the transitory amount of fuel to be provided to the engine during operation of the engine; and delivering an amount of fuel to the engine that is equal to the steady-state quantity of fuel plus the manipulated transitory quantity of fuel.

51. A method of adjusting a fuel quantity delivered to an engine, comprising:

determining a current quantity of fuel to be delivered to the engine;

adding a transitory amount of fuel to the current quantity of fuel to be delivered to the engine based on a change from a previous quantity of fuel to be delivered to the engine to the current quantity of fuel to be delivered to the engine.

52. The method of claim 51, wherein the transitory quantity of fuel is negative.

53. The method of claim 51, wherein the transitory quantity of fuel is added for a predetermined period of time.

54. The method of claim 53, wherein the period of time is measured by a number of cycles of a piston in the engine.

55. The method of claim 51, wherein the change from the previously determined quantity of fuel to the current steady-state quantity of fuel is cause by a change in at least one of engine speed and engine load.

* * * * *

UNITED STATES PATENT AND TRADEMARK OFFICE

CERTIFICATE OF CORRECTION

PATENT NO. : 6,701,897 B2
DATED : March 9, 2004
INVENTOR(S) : Glen F. Chatfield

It is certified that error appears in the above-identified patent and that said Letters Patent is hereby corrected as shown below:

Column 19,
Line 30, please delete the word "the"
Line 35, please delete the first occurance of the word "the"
Line 39, please add -- 24, -- after the word "claim"

Column 20,
Line 67, please add the word -- by -- after the word "driven"

Column 22,
Line 20, please change the word "cause" to -- caused --

Signed and Sealed this

Twenty-sixth Day of July, 2005

JON W. DUDAS
*Director of the United States Patent and Trademark Office*